United States Patent [19]

Ehret et al.

[11] Patent Number: 4,491,490

[45] Date of Patent: Jan. 1, 1985

[54] CONTROL DEVICE AND METHOD FOR GLUING TOGETHER CONTINUOUS FORM SETS

[76] Inventors: Bernhard Ehret, Im Glaser 25, D-7800 Freiburg; Stephan Ferroni, Hans-Sachs-Strasse 32, D-7835 Teningen, both of Fed. Rep. of Germany

[21] Appl. No.: 499,950

[22] Filed: Jun. 1, 1983

[30] Foreign Application Priority Data

Jun. 1, 1982 [DE] Fed. Rep. of Germany ..... 3220629

[51] Int. Cl.[3] ..... B05C 5/00

[52] U.S. Cl. ..... 156/64; 118/663; 118/669; 118/672; 118/679; 156/356; 156/378; 250/202; 250/160; 377/17

[58] Field of Search ..... 118/663, 669, 672, 679, 118/682–685; 156/356–357, 378, 64, 548; 377/17, 18, 53; 250/202, 568, 560

[56] References Cited

U.S. PATENT DOCUMENTS

| | | | |
|---|---|---|---|
| 4,013,037 | 3/1977 | Warning et al. | 118/685 |
| 4,102,492 | 7/1978 | Gold et al. | 364/468 X |
| 4,164,001 | 8/1979 | Patnaude | 118/684 X |
| 4,234,787 | 11/1980 | Hutler et al. | 377/17 |
| 4,363,271 | 12/1982 | Horst | 250/548 X |

FOREIGN PATENT DOCUMENTS

| | | |
|---|---|---|
| 2707011 | 10/1977 | Fed. Rep. of Germany . |
| 2707012 | 10/1977 | Fed. Rep. of Germany . |
| 2902319 | 7/1979 | Fed. Rep. of Germany . |

*Primary Examiner*—David Simmons

*Attorney, Agent, or Firm*—Schwartz, Jeffery, Schwaab, Mack, Blumenthal & Koch

[57] ABSTRACT

A device for controlling the glue nozzles of a machine for gluing together at least two paper webs provided with recurring form designs to produce multi-part sets of continuous forms. The control device has at least one sensing element and at least one glue nozzle which are both connected to a computer. Also connected to the computer is a displacement transducer for determining the position of the beginning of a form with respect to the respective glue nozzle. In a "read-in" mode, the sensing elements senses a specially treated read-in form, and the values obtained are stored in the computer. In a second mode, the "glue" mode, the computer activates the glue nozzles precisely when the displacement transducer provides an address for which a "glue" instruction was stored during read-in.

26 Claims, 9 Drawing Figures

| Counter I | Counter I+E | RAM | Counter T+A | RAM | Output Stage |
|---|---|---|---|---|---|
| 10 | 15 | 0 | 20 | 0 | 0 |
| 15 | 20 | 0 | 25 | 1 | 0 |
| 20 | 25 | 1 | 30 | 1 | 1 |
| 65 | 70 | 1 | 75 | 1 | 1 |
| 66 | 71 | 1 | 76 | 0 | 0 |
| 80 | 85 | 0 | 90 | 0 | 0 |

CONTROL DEVICE AND METHOD FOR GLUING TOGETHER CONTINUOUS FORM SETS

BACKGROUND OF THE INVENTION

The present invention relates to a control device for the glue nozzles of a machine for gluing together at least two paper webs provided with recurring form designs to produce multi-part sets of continuous forms. A control device of this kind can also be used to control other devices for joining together two or more paper webs to produce multi-part sets if, by way of exception, a joining technique other than gluing should be chosen. One possible other joining technique consists, for example, of pulling an adhesive tape through the sprocket holes at the edges of the continuous paper webs.

Continuous form sets frequently consist of several layers, e.g., for multi-part invoice form sets. Each layer consists of a paper web with recurring form designs. The webs must be precisely aligned in relation to each other, so that associated form designs are superposed so as to permit copies to be made. The precisely aligned paper webs are joined together, usually glued together, and then provided with a cross perforation by a cross-perforation cylinder.

In the majority of multi-part sets of continuous forms it is not permitted to make continuous glue joints in the form of longitudinal strips. As a rule, it is required that the glue strips be interrupted, and it may also be necessary to provide glue strips in different locations and of different length between different paper webs. The glue nozzles applying the glue must thus be switched on and off precisely as a function of the position of a form with respect to the glue nozzle. This necessitates a control device.

A known control device for this purpose is, for example, a position-encoder disk connected to the shaft of the cross-perforation cylinder. The position-encoder disk is provided with segment-shaped aluminum strips. During rotation of the disk, these aluminum strips are sensed by inductive sensors. Each inductive sensor is connected to a control circuit via which the output stage for an associated glue nozzle is controlled. The lengths and locations of the aluminum strips are chosen so that the glue nozzle controlled by the inductive sensor applies the glue to the form precisely in the right area. The length and location of each aluminum strip must be determined empirically.

If used for changing form designs, such a known control device requires a large amount of labor. It is necessary to operate one position-encoder disk for each nozzle and to use different position-encoder disks for different designs. As a result, a large number of position-encoder disks have to be kept in stock, and much changeover work is required. When changing from a size of, e.g., 8 inches to one of, e.g., 12 inches, the position-encoder disks must be turned relative to the cross-perforation cylinder even if the relative dimensions of the gluing pattern remain constant. This is due to the fact that the glue nozzles are permanently attached to a gluing machine, while the beginnings of the forms shift in relation to the glue nozzles if form lengths are changed. This shift must be compensated for by turning the position-encoder disks about the shaft of the cross-perforation cylinder.

SUMMARY OF THE INVENTION

The object of the invention is to improve a known control device so as to permit changes in form lengths and in the locations and lengths of glue strips without the need for much changeover work.

In a control device in accordance with the invention, the control circuit is designed as a computer. In this computer, the displacement of the beginning of a form with respect to a glue nozzle is stored. It is not absolutely necessary that the beginning of each form be marked with the displacement value zero, but it suffices to provide one recurring displacement value for the beginning of each form. This value is obtained from a conventional digital or analog displacement transducer.

The control device in accordance with the invention further includes a sensing element for determining those areas of a form to be glued. The areas to be glued are first marked on a read-in form, e.g., by means of metal strips. At the beginning of a working cycle, this read-in form is laid on the uppermost of the webs so as to coincide with the form therebelow. Together with the web, it is then moved past the sensing elements. The sensing elements then determine, e.g., by inductive measurement, whether or not an aluminum strip is present as a function of the displacement determined by the displacement transducer. This presence or absence of the aluminum strip is stored in the computer at the beginning of the working cycle. The computer is then changed over to "gluing". Depending on the displacement of the forms to be glued together, the computer provides a "glue" or "do not glue" signal via the output stages to the glue nozzles. This signal is provided depending on whether or not an aluminum strip was present in the corresponding area during the first step, the "read-in" step.

From the foregoing it is apparent that a control device in accordance with the invention permits form designs and the locations and lengths of glue strips to be changed in a very simple manner. It is only necesary to provide a read-in form with aluminum strips in the areas to be provided with glue. Thus, it suffices to stock one read-in form for each type of form to be produced. When changing forms in terms of size or design, no changeover work has to be done; it is only necessary to pass a read-in form through the machine and set the computer of the control device according to the invention to the "read" mode. The areas to be glued may also be marked on the read-in form by other means than aluminum strips, such as strongly and weakly reflecting areas, luminescent materials, or mechanically sensible areas. For each type of marking, a suitable sensing element must be used.

The control device in accordance with the invention not only has the advantage of nearly completely eliminating the need for changeover work, but also makes it possible to compensate for dead times of the glue nozzles in the simplest manner. Fixed dead times can be compensated for by adding to the displacement value determined by the displacement transducer a value corresponding to the displacement of the paper webs during the fixed dead time. In this manner, each glue nozzle is activated at instants preceding their actual turn-on and turn-off instants, respectively, by the dead time.

However, there is the problem that the faster the paper webs move, the earlier the glue nozzles must be switched on and off. This problem, too, can be solved with the control device according to the invention in a simple manner. A dead-time address generator determines the displacement of a paper web during a predetermined dead time. This displacement is then added to the actual displacement of the paper web. If the web moves faster, the displacement during the dead time will be greater; if it moves slower, the displacement will be smaller. Thus, if a web moves fast, a glue nozzle will be switched on and off earlier than if it moves slowly. A similar control system for final control elements with dead times in printing machines is disclosed, for example, in German Offenlegungsschrift No. 27 07 011 and German Offenlegungsschrift No. 27 07 012.

Another problem is that the turn-on dead time of a glue nozzle is, as a rule, shorter than its turn-off dead time. Such different dead times, too, can be compensated for with a control device according to the invention in a simple manner. To do this, the displacement of a paper web or a form during the turn-on dead time and the displacement during the turn-off dead time are determined. These values are added to the respective actual displacement value. It is then determinecd whether for the two displacement sums, a value indicating "glue" or "do not glue" is stored in the computer. Only if a "glue" value is indicated for both displacement sums will the glue nozzles be activated via the output stages. This measure ensures that different turn-on and turn-off dead times of glue nozzles are compensated for irrespective of whether paper webs move slow or fast.

BRIEF DESCRIPTION OF THE DRAWINGS

Embodiments and developments of the control device in accordance with the invention and methods using such control devices will now be described in more detail with reference to the accompanying drawings, in which.

Figure 1:
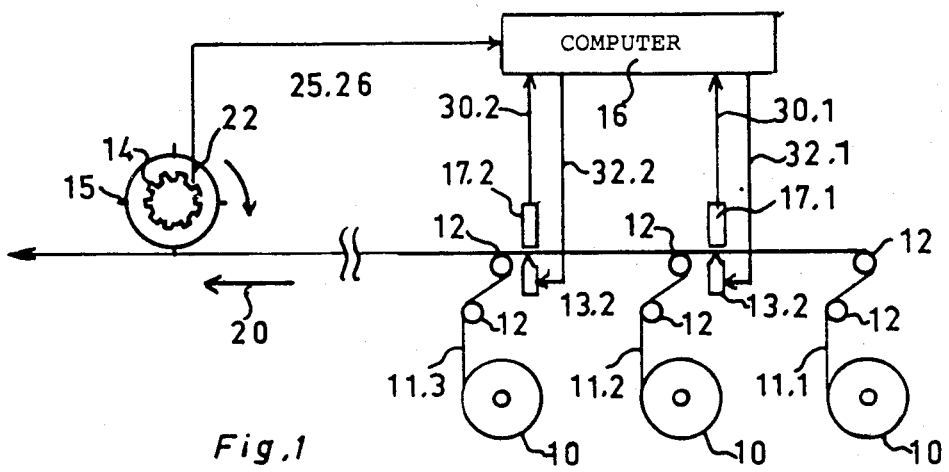
FIG. 1 is a schematic side view of a gluing machine with control device.

The gluing machine with control device shown in FIG. 1 includes three rolls 10 with printed paper webs wrapped thereon. The three webs 11.1 to 11.3 run over guide rollers 12 so as to finally lie on top of one another. Before being laid one on top of the other, however, they are provided with glue in given areas via glue nozzles 13.1 and 13.2. The webs are so aligned in relation to each other that form designs associated with one another precisely coincide. The webs thus glued together are then divided into the individual forms of the multipart continuous form set by cross perforations made by a cross-perforation cylinder 14 with blades 15. The continuous set is then folded, which is not shown in FIG. 1. The paper transport mechanism is also not shown for purposes of clarity. The webs are driven via sprockets holes in their margins.

Figure 3:
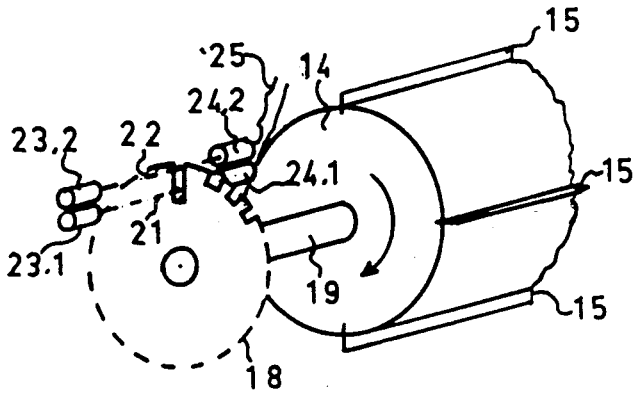
FIG. 3 is a schematic perspective view of a perforation cylinder with a displacement transducer cooperating with this cylinder.

The control device comprises a computer 16, two sensing elements 17.1 and 17.2, and a displacement transducer with a toothed disk 18 (FIG. 3).

The circumference of the cross-perforation cylinder 14 is equal to an integral multiple of one form length. In the examples of FIGS. 1 and 3, the cross-perforation cylinder 14 has four blades 15, which corresponds to a circumferential length of four forms. The toothed disk 18 is mounted on the shaft 19 of the cross-perforation cylinder. This fixed relationship between toothed disk and cross-perforation cylinder and, on the other hand, the fixed relationship between the circumference of the cross-perforation cylinder and one form length results in a fixed relationship between the number of teeth moving past a fixed point and the longitudinal position of a form with respect to a fixed point in the direction of paper motion 20.

The fixed point from which the number of passing teeth is counted is determined by an especially deep slit 21 in the toothed disk 18, as shown in FIG. 3. The count slits 22 of the toothed disk are less deep than the slit 21. On one side of the toothed disk 18, two light sources 23.1 and 23.2 are so arranged that the light of one of them, 23.1, can pass only through the deep slit 21, while the light of the second light source, 23.2, can pass through all slits. On the other side of the toothed disk 18 are two light-sensitive cells 24.1 and 24.2. The light-sensitive cell 24.1 receives the light from the light source 23.1 that has passed through the deep slit 21. The light-sensitive cell 24.2 receives the light from the light source 23.2 that has passed through the slits 21 and 22. The light-sensitive cells 24.1 and 24.2 are connected to the computer 16 by a zero line 25 and an increment line 26, respectively.

The action of the sensing elements 17.1 and 17.2 will now be explained with the aid of FIG. 2. Viewed perpendicular to the direction of paper motion 20, the sensing element 17.1 is in line with the glue nozzle 13.1, as indicated by the broken line 27.1. Correspondingly, the sensing element 17.2 is in line with the glue nozzle 13.2.

A read-in form 28, shown hatched, has been laid on the top web 11.1 so as to precisely coincide with the form below it. This read-in form 28 has an aluminum strip 29.1 exactly the length along which the glue nozzle 13.1 is to apply glue. As the webs 11.1 to 11.3 are moved in the direction 20, the read-in form 28 with the aluminum strip 29.1 passes below the sensing element 17.1. The latter is an inductive sensor and thus senses whether or not the aluminum strip 29.1 is passing below it. It sends this information over the sensor line 30.1 to the computer 16. At the same time, the computer 16 is informed of the displacement of a form over the increment line 26, as described above. By linking the data from the sensor line and the increment line, the computer determines where or where not a form has to be glued. Corresponding information is derived for the glue nozzle 13.2 via the second sensing element 17.2 by sensing a second aluminum strip 29.2 on the read-in form 28. The values provided by the sensing element 17.2 are transferred to the computer 16 over a sensor line 30.2.

As already explained with the aid of FIGS. 1 and 3, the number of teeth of the toothed disk 18 passing by the light-sensitive cell 24.2 is counted up from zero, the zero value being fixed by the deep slit 21. With displacement transducers at conventional control devices it was necessary that the beginning 31 of a form to be glued—in FIG. 2, this beginning is identical with the beginning of the read-in form 28—be present at the first glue nozzle 13.1 when the displacement transducer indicated zero. In the present case, this is no longer necessary. If, for example, ten teeth were counted when the beginning 31 of the form is above the glue nozzle 13.1, and the sensing element 17.1 indicates that glue has to be applied from the 35th tooth, this value remains stored in the computer for all subsequent forms passing through the machine. This eliminates the need to adapt the toothed disk 18 to the beginning 31 of a new type of form by turning it about the shaft 19. The toothed disk 18 of FIG. 3 has 480 teeth, for example. With four forms per revolution of the cross-perforation cylinder 14 and, hence, of the toothed disk 18, 120 teeth are available per form length. For higher or lower displacement accuracies, a correspondingly greater or smaller number of teeth can be used. In this example, and in the example described in the previous paragraph, glue has to be applied to a first form from the 35th tooth, to the following form from the 155th tooth, to the third form from the 275th tooth, and to a fourth form from the 395th tooth. To the next form, glue has to be applied from the 35th tooth again.

As is apparent from the foregoing, the control device of FIG. 1 works in two steps. The first step is "read in", and the second step is "glue". When the control device is in the "read-in" mode, the sensing elements 17.1 and 17.2 determine the areas to be glued and send their measured values over the sensor lines 30.1 and 30.2 to the computer. In the second step, the "glue" step, the computer 16 sends control signals over the control lines 32.1 and 32.2 to the glue nozzles 13.1 and 13.2, respectively, precisely over the distances found during read-in to be provided with aluminum strips 29.1 and 29.1, respectively, on the read-in form 28.

Figure 4:
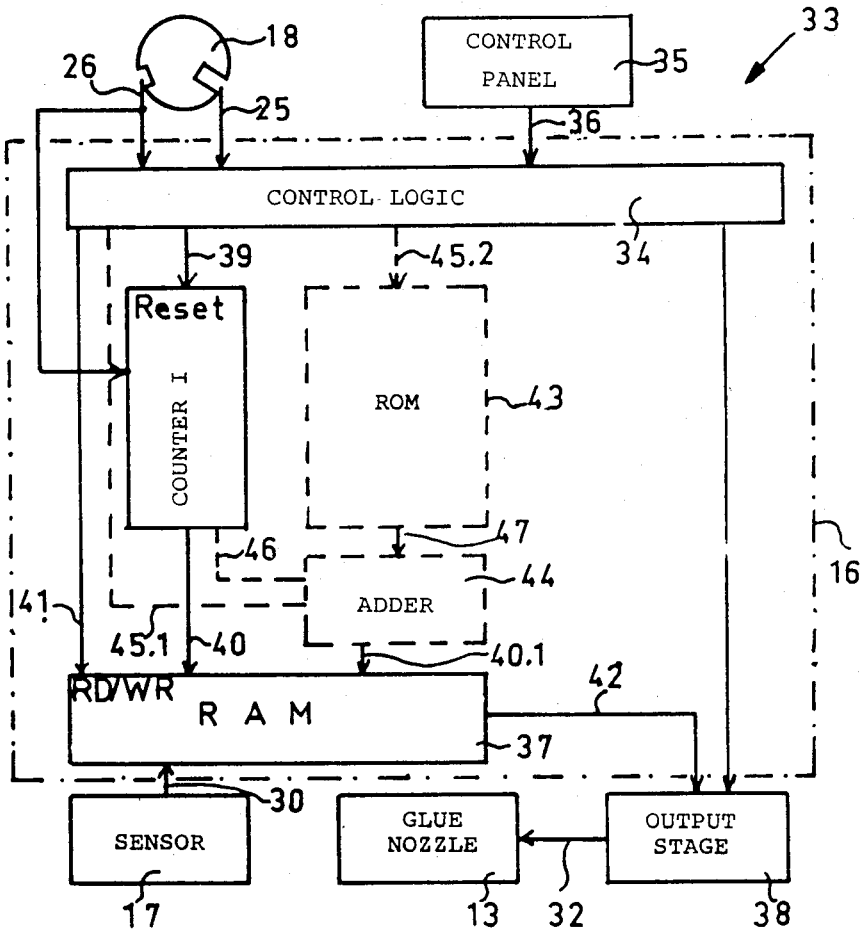
FIG. 4 is a block diagram of a control device without dead-time compensation but—indicated by broken lines—fixed-value dead-time compensation.
Figures 7, 9:
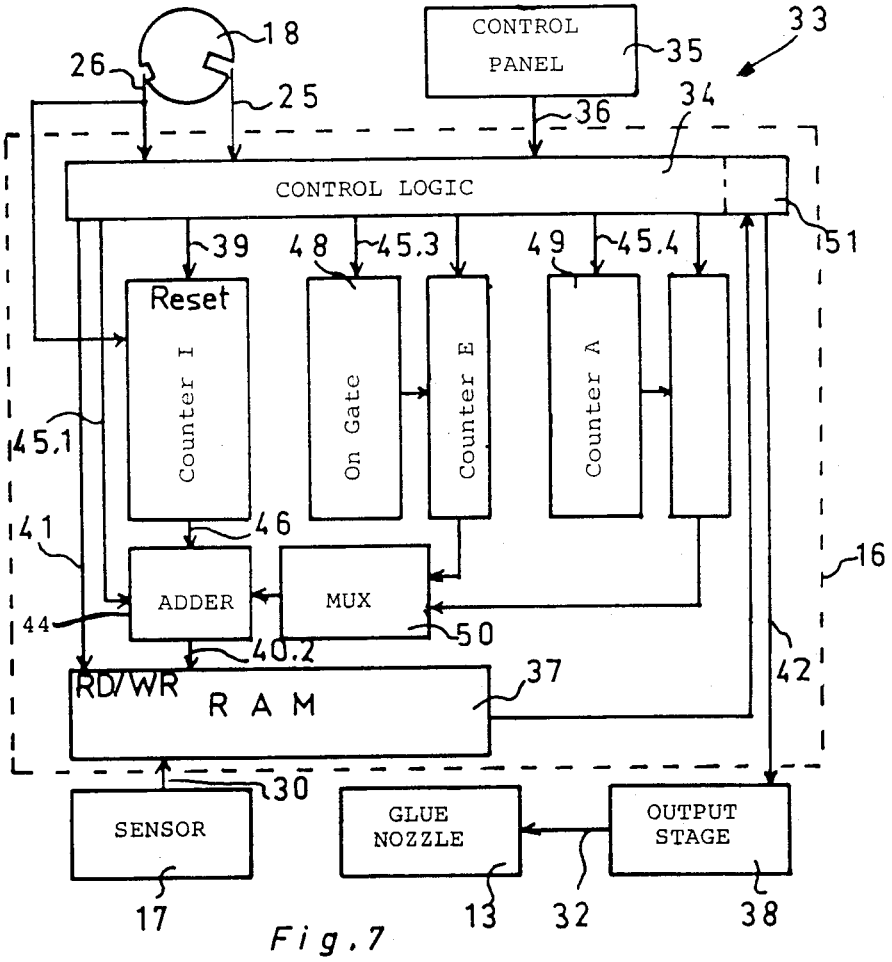
FIG. 7 is a block diagram of a control device to compensate for unequal turn-on and turn-off dead times of glue nozzles.
FIG. 9 is a table of values stored in a memory and delivered to an output stage depending on the counts of various counters.

FIGS. 4 and 7 show control devices 33 in more detail. The central facility of the control device is the computer 16. The zero line 25 and the increment line 26, which were described above, are connected to a control logic 34 in the computer, which also has a control panel 35 connected to it via a line 36. Via the control panel 35, the "read-in" or "glue" instruction can be given. In the embodiment of FIG. 7, it is also possible to enter dead times through the control panel 35. As was also stated above, at least one sensor 17 is connected to the computer 16 by a sensor line 30. As shown in more detail in FIGS. 4 and 7, the sensor line 30 runs to a random-access memory 37. Outputs of the computer 16 are connected to an output stage 38, which controls the glue nozzle 13 via the control line 32.

In the following, embodiments and the operation of computers 16 will be described in more detail with the aid of FIGS. 4 to 9. The computer 16 of FIG. 4 consists, in its simplest form, of the control logic 34, the memory 37, and an increment counter I, which is connected to the increment line 26 and, via a RESET line 39, to the output of the control logic 34. The counter I is connected to the memory 37 by an address line 40. The memory is connected to the control logic 34 by a read/-write line 41. The data output of the memory 37 is connected to the output stage 38 by an output line 42.

The operation of this structure is as follows. Assuming that a "read-in" instruction is entered through the control panel 35, the control logic 34 resets the counter I to zero over the RESET line 39 upon receipt of a signal from the zero line 25. The counter I then counts the increments received from the increment line 26. The count is transferred as an address to the memory 37 over the address line 40. This memory receives signals over the sensor line 30 when the sensor 17 senses on a read-in form 28 an area to be glued, as shown in FIG. 2. In addition, the memory 37 is instructed by the control logic 34 over the read/write line 41 to store the values received from the sensor 17 in the addresses received over the address line 40. When the read-in form 28 has been "read through", the memory 37 contains precise information as to where glue is to be applied and where not.

Then, a "glue" instruction is entered through the control panel 35. In response to this instruction, the control logic 34 sends a write, i.e. output, signal to the memory 37 over the read/write line 41. Via the increment line 26, the counter I, and the address line 40, the addresses in the memory 37 are counted up again. Addresses for which the sensor 17 determines no signal during the read-in operation contain a logic "0", while addresses for which a signal was received contain a logic "1". These values are transferred over the output line 42 to the output stage 38, which then controls the glue nozzle 13 via the control line 32.

FIG. 4 also shows an improved design of the circuit just described, which is indicated by broken lines. The computer 16 additionally includes a read-only memory 43 and an adder 44. The address line 40 between the counter I and the memory 37 is no longer present. Instead, there is an address line 40.1 between the adder 44 and the memory 37. The adder 44 is connected to the control logic 34 by an enable line 45.1, and to the counter I by a count line 46. The read-only memory 43 is connected to the control logic 34 by an enable line 45.2, and to the adder by a fixed-value line 47.

The operation of this circuit is as follows. In the "read-in" mode, the circuit works essentially as the one just described. The only difference is that the count of the counter I is transferred to the memory 37 not directly via the address line 40, which is no longer present, but via the count line 46, the adder 40, and the address line 40.1. Via the enable line 45.1, the adder 44 is instructed to perform no additions but to pass the count from the counter I direct to the memory 37.

Figure 5:
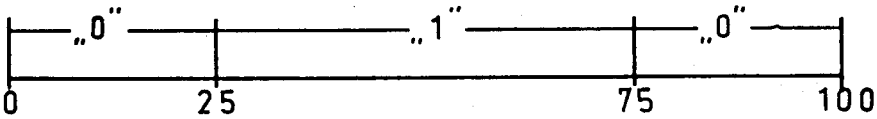
FIG. 5 shows schematically values for a control device without dead-time compensation which are stored in memory addresses.
Figure 6:
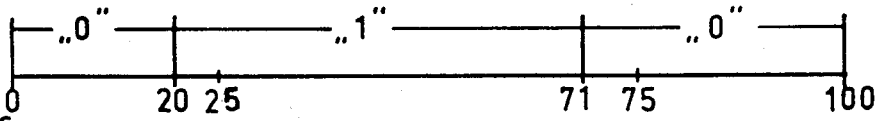
FIG. 6 is a representation as in FIG. 5 but with fixed-value dead-time compensation.

In the "glue" mode, however, the read-only memory and the adder 44 are enabled. The read-only memory 43 holds a number of increments which corresponds to the displacement of a form during an average turn-on and turn-off dead time of a glue nozzle. In the adder 44, this fixed value is added to the count from the counter I, so that the memory 37 receives a value with dead-time compensation which is higher than the count from the counter I. As a result, the glue nozzle 13 is activated before a form passing over the glue nozzle reaches the glue nozzle with the area to be glued. Because of the delay between the activation or deactivation of the glue nozzle and the beginning or end, respectively, of the actual glue application, however, the beginning of the area to be provided with glue will be precisely above the nozzle when the latter starts to apply glue at the end of the "on" dead-time, and the end of this area will be above the nozzle when the latter stops applying glue at the end of the "off" dead time. The general address values given in the foregoing are illustrated by examples in FIGS. 5 and 6. The aluminum strip 29.1 of FIG. 2 is taken as a basis. It is deposited on the read-in form 28 in such a way that approximately the first quarter of the form is to remain free of glue, that the middle half is to be provided with glue, and the the last quarter is to remain free of glue again. With a total of 100 increments over the entire form length, glue is thus to be applied from the 25th to the 75th increment inclusive. The addresses 0 to 24 in the memory 37 thus contain a logic "0", the addresses 25 to 75 a logic "1", and the addresses 76 to 100 a logic "0". This is illustrated in FIG. 5. To perform dead-time compensation, five increments, for example, are added to each total number of increments counted by the counter I. Thus, if the counter I has counted 20 increments, the address "25" appears at the memory 37. For this address, however, a logic "1" is stored. The glue nozzle 13 is thus already activated when the counter I has counted only 20 increments. If, however, the counter I has counted 71 increments, for example, the address "76" will be sent to the memory 37 via the adder 44. For this address, however, a logic "0" is stored in the memory 37. Thus, the glue nozzle 13 is no longer activated already from the increment value "71".

With the control device described with the aid of FIG. 4, dead-time compensation is possible only with a fixed value, which does not take into account whether the forms to be provided with glue pass the glue nozzle fast or slow. This can be taken into account with the circuit of FIG. 7. Only the interior of the computer 17 will be described, because the other parts of the control device 33 were already described in connection with FIG. 4. The computer 16 again contains the control logic 34, the counter I, and the memory 37. Two additional counters are provided, namely a counter E, which cooperates with an "on" dead-time gate 48, and a counter A, which cooperates with an "off" dead-time gate 49. The computer further includes a multiplexer 50 and an adder 44.

A dead-time gate and the counter associated therewith cooperate as follows. A dead time entered through the control panel 35 is preset by the dead-time gate while the associated counter is counting. In this manner, a speed-dependent number of increments is determined. If the machine runs slow, the toothed disk 18 provides only few increments during the dead time; if the machine runs fast, the disk 18 provides many increments. If the read-only memory 43 of FIG. 4 is replaced with a dead-time gate and an associated counter, it is now possible not only to add a fixed number of increments to each increment count of the counter I to compensate for dead times, but also to effect a speed-dependent compensation. In addition, the circuit of FIG. 7 is capable of taking into account not only different speeds but also different "on" and "off" dead times of the glue nozzles 13.

The "on" dead time of a glue nozzle 13, is for example, about 11 ms, while the "off" dead time is about 23 ms, i.e., about twice as long. Let us assume that the counter E counts five increments during the "on" dead time communicated to it by the "on" dead-time gate 48, while the counter A counts ten increments during the "off" dead time communicated to it by the "off" dead-time gate. These increments are transferred alternately to the adder 44 via the multiplexer 50. Via the adder 44, groups of three associated increment values are transferred into the memory 37, namely an increment value determined by the counter I and forming the output address, a second increment value consisting of the output address plus the value determined by the counter E, and a third value consisting of the output address and the value determined by the counter A. For each of these three different addresses, a given logic value is stored in the memory 37.

Figure 8:
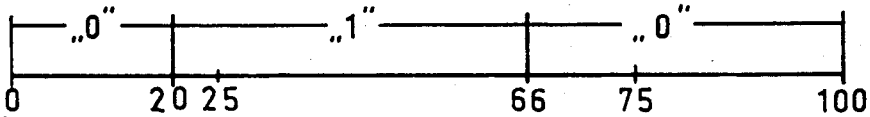
FIG. 8 is a representation as in FIG. 5 but with compensaton for different turn-on and turn-off dead times.

The values stored for such different addresses are shown in FIG. 9. If the counter I provides the address "10", the address "15" is obtained by adding the value from the counter E. For this address, a logic "0" is stored in the memory 37. If the increment value "10" from the counter A is added to the address from the counter I, the address "20" is obtained. For this address, a logic "0" is stored in the memory 37. The output stage will not be activated in this case. If the counter I then provides the address "15", the two other address values are "20" and "25". For the first of these two values, a logic "0" is stored in the memory 37; for the second, a logic "1" is stored. Since one of the two values is still "0", the output stage is not activated yet. If the counter I then provides the address "20", the two other addresses are "25" and "30". For each of these two address values, a logic "1" is stored in the memory. The output stage is now activated. This is desired, since, because of the "on" dead time of 11 ms assumed in this example, the glue nozzle 13 is to be switched on already five increments before the address value determined by the counter I without dead time during read-in. As the forms move on, and the counter I reaches the address value "65", the two other addresses are "70" and "75". For both address values, a logic "1" is stored in the memory. The output stage thus keeps the glue nozzle 13 on. When the counter I reaches the address "66", the two other address values are "71" and "76". For these address values, a logic "1" and a logic "0", respectively, are stored in the memory 37. Since the two logic values are no longer both "1", the output stage deactivates the glue nozzle 13. Thus, the glue nozzle is deactivated already ten increments before the number of increments determined by the counter I during read-in for the deactivation of the glue nozzle 13. This, however, is precisely what is desired, because, in the example chosen, the turn-off dead time of 23 ms corresponds to an increment value "10", which is to be taken into account. This sequence is illustrated in FIG. 8. For the output addresses "0"; for the addresses "20" to "65", it provides a logic "1", and for the address values "66" to "100", it provides a logic "0" again.

The determination of the memory contents for the respective addresses and their comparison as to whether the memory contents are both "1" are performed in a comparator 51, which forms part of the control logic 34. This comparator 51 is connected via an output line 42 to the output stage 38 and activates the latter only if the address values determined from the sums of the counters I and E and of the counters I and A both led to an address content of the logic value "1".

In the control devices 33 of FIGS. 4 and 7, only one sensor 17 and one glue nozzle 13 are shown. One sensor and one glue nozzle are required if only two paper webs are to be glued together. Frequently, however, five or six webs have to be glued together. Then, a correspondingly larger number of sensors and glue nozzles with associated output stages are necessary. The various sensors then deliver their values for an address to the memory 37 in parallel or in a multiplex mode. The memory stores the value for each address and activates or deactivates the respective output stage in a multiplex mode.

In the embodiment of FIG. 7, two dead-time gates and two counters cooperating with them are used to compensate for turn-on and turn-off dead times. It is also possible to use only one gate and one counter which, however, must be operated in a multiplex mode. Also, a logic different from that described may be used which compares the memory contents for different addresses to determine whether both memory contents are logic "1" or not. The approach described is particularly advantageous, however.

In connection with FIGS. 1 and 3 it was described that the displacement transducer consists of a toothed disk 18, light sources 23, and light-sensitive cells 24. However, other displacement transducers, e.g., inductive or mechanical digital displacement transducers, may also be employed. It is also possible to use analog displacement transducers whose values must be digitized by means of a converter before being entered into the computer 16.

In connection with FIGS. 1 and 3 it was also stated that the displacement transducer is rigidly connected with the cross-perforation cylinder. However, it may be connected with any shaft of the gluing machine which provides a fixed relationship between the revolution of the shaft and the displacement of a form.

Figure 2:
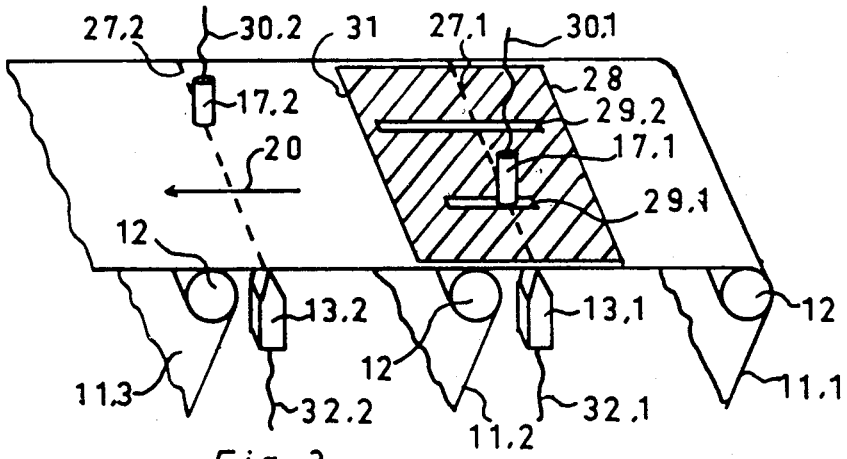
FIG. 2 is a perspective side view of the gluing station of a gluing machine with glue nozzles and sensing elements.

In connection with FIGS. 1 and 2 it was stated that the read-in form 28 is to be provided with aluminum strips 29 in the areas where glue is to be applied. Strips for different sensing elements are to be arranged side by side, and the sensing elements are to be in line with the glue nozzles 13 when viewed perpendicular to the direction of paper motion 20. All these conditions may also be varied. For instance, strips of different luminescent materials may be laid one on top of the other which are then detected by light-sensitive cells of different sensitivity. If it is not possible to mount the displacement transducers in line with the glue nozzles, such differences in position must be taken into account in the computer by corresponding increment numbers. For measured-value acquisition, it is advantageous in any case to use sensors having as short a dead-time as possible.

While the control devices of the prior art use displacement transducers which determine the displacement of a form and simultaneously indicate whether or not glue is to be applied, the control device in accordance with the invention employs a displacement transducer which delivers only increments, either directly or after analog-to-digital conversion. In the other prior art, the circuit between the displacement transducer and the glue nozzles serves only to pass on the signals received from the displacement transducer. In the control device according to the invention, the circuit, designed as a computer, serves to store signals received from sensing elements and defining areas to be provided with glue, and then to pass the stored values to the output stages for the glue nozzles on the occurrence of given numbers of increments.

What is claimed is:

1. A control device for a glue nozzle of a machine for gluing together at least two paper webs each provided with recurring forms thereon for producing multi-part sets of continuous forms, comprising:

(a) a displacement transducer for determining the position of the beginning of each form on one of said webs with respect to the glue nozzle, (b) at least one sensing element positioned adjacent at least one of said webs for determining during a read-in mode those areas of each form to be provided with glue by sensing a predetermined pattern on a read-in form positioned on said at least one of said webs, (c) a control circuit responsive to the displacement transducer and the at least one sensing element, said control circuit including a computer, and (d) output means responsive to said computer for switching the glue nozzle on and off.

2. A control device as recited in claim 1, wherein the sensing element comprises an inductive sensor.

3. A control device as recited in claim 1, wherein the displacement transducer comprises a toothed disk which is disposed between a light source and a light-sensitive cell and, when rotated, alternately intercepts and clears the light path.

4. A control device as recited in claim 2, wherein the displacement transducer comprises a toothed disk which is disposed between a light source and a light-sensitive cell and, when rotated, alternately intercepts and clear the light path.

5. A control device as recited in claim 1, wherein the computer has a memory which is controlled with the values from the displacement transducer and the sensing element, the value from the displacement transducer defining an output address, and the respective associated value from the sensing element defining the respective address content.

6. A control device as recited in claim 2, wherein the computer has a memory which is controlled with the values from the displacement transducer and the sensing element, the value from the displacement transducer defining an output address, and the respective associated value from the sensing element defining the respective address content.

7. A control device as recited in claim 3, wherein the computer has a memory which is controlled with the values from the displacement transducer and the sensing element, the value from the displacement transducer defining an output address, and the respective associated value from the sensing element defining the respective address content.

8. A control device as recited in claim 4, wherein the computer has a memory which is controlled with the values from the displacement transducer and the sensing element, the value from the displacement transducer defining an output address, and the respective associated value from the sensing element defining the respective address content.

9. A control device as recited in claim 5, wherein the computer has read-only memory which increases each output address determined from the value of the displacement transducer by a fixed value to compensate for the dead time of said glue nozzle.

10. A control device as recited in claim 5, wherein the computer has at least one dead-time address generator which increases each output address determined from the value of the displacement transducer by a value depending on the form speed determined by the displacement transducer in order to compensate for the dead time of a glue nozzle.

11. A control device as recited in claim 10, wherein each dead-time address generator has a dead-time gate and a counter which counts the number of increments received from the displacement transducer within the time predetermined by the dead-time gate.

12. A control device as recited in claim 10, wherein the computer has two dead-time address generators, namely an "on" dead-time address generator to compensate for the turn-on dead time of the glue nozzle, and an "off" dead-time address generator to compensate for the turn-off dead time of the glue nozzle.

13. A control device as recited in claim 11, wherein the computer has two dead-time address generators, namely an "on" dead-time address generator to compensate for the turn-on dead time of the glue nozzle, and an "off" dead-time address generator to compensate for the turn-off dead time of the glue nozzle.

14. A control device as recited in claim 12 wherein the computer has a comparator which provides a logic "1" only if both the content of the output address compensated with the value of the "on" dead-time generator and the content of the output address compensated with the value of the "off" dead-time generator are logic "1."

15. A control device as recited in claim 1, further including a read-in form having read-in strips thereon, capable of being sensed by the sensing elements for indicating areas of the form to be provided with glue.

16. A control device as recited in claim 5, further including a read-in form having read-in strips thereon, capable of being sensed by the sensing elements for indicating areas of the form to be provided with glue.

17. A control device as recited in claim 9, further including a read-in form having read-in strips thereon, capable of being sensed by the sensing elements for indicating areas of the form to be provided with glue.

18. A control device as recited in claim 15, wherein the read-in strips are metal strips.

19. A control device as recited in claim 10, further including a read-in form having read-in strips thereon, capable of being sensed by the sensing elements for indicating areas of the form to be provided with glue.

20. A method of controlling a glue nozzle of a machine for gluing together at least two paper webs provided with recurring forms thereon for producing multi-part sets of continuous forms comprising the steps of:

(a) determining the position of the form with respect to the glue nozzle using a displacement transducer;

(b) positioning a read-in form on top of at least one of said webs, said read-in form having read-in indications thereon;

(c) sensing the position of said read-in indications on said read-in form using at least one sensing element;

(d) storing information in a control computer indicating the areas of the form to be provided with glue as determined from said sensing element and at addresses as indicated by said displacement transducer; and (e) while moving said forms and in response to said diplacement transducer, energizing said glue nozzle for gluing said forms when said stored information from said computer indicates glue is to be applied.

21. A control device for a glue nozzle of a machine for fluing together a first web and a second web provided with recurring form designs for producing multi-part sets of continuous forms, comprising:

an incremental displacement transducer for determining the position of a beginning of each form with respect to the glue nozzle and generating signals indicative of incremental displacement of the form from said position;

at least one sensing element within sensing range of the first web for determining in a read-in mode areas of the first web to be provided with glue strips;

a computer including means for counting the incremental displacement signals delivered from said incremental displacement transducer, means for storing an indication of incremental displacements being related to a beginning and an end of each glue strip, said incremental displacements being those at which a signal from the displacement transducer coincides with a signal from said sensing element in the read-in mode, and means for delivering an output signal in a glue mode each time an incremental displacement signal delivered from said displacement transducer coincides with an incremental displacement indication stored in the storing means; and output means responsive to the output signals from the computer for switching the glue nozzle on and off.

22. An apparatus for controlling a glue nozzle of a machine for gluing together at least two paper webs provided with recurring form desings for producing multi-part sets of continuous forms, comprising:

means for determining the position of the form designs with respect to the glue nozzle;

a read-in form disposed on top of at least one of said webs in a read-in mode of operation of said apparatus, said read-in form having read-in indications thereon;

means for sensing the position of said read-in indications on said read-in form;

means for storing information indicating the areas of the form design to be provided with glue as determined by said sensing means and at addresses as indicated by said position-determining means; and means for energizing said glue nozzle while moving said webs in response to said means for determining position when said stored information indicates that glue is to be applied.

23. An apparatus for programming a control device for a glue nozzle of a machine for gluing together a first web and a second web provided with recurring forms thereon for producing multi-part sets of continuous forms, comprising:

a read-in form positioned on the first web, having a size and configuration of the recurring form design, and provided with means capable of being sensed positioned at areas corresponding to areas to receive glue on said first web;

means for determining a position of the recurring forms with respect to the glue nozzle;

means for sensing the means capable of being sensed on the read-in form; and means for storing information in a control computer indicating the areas of the recurring forms to be provided with glue as determined by said sensing means at addresses indicated by said position-determining means.

24. A method of programming a control device for a glue nozzle of a machine for gluing together at least two paper webs provided with recurring forms thereon for producing multi-part sets of continuous forms comprising the steps of:

(a) determining the position of the form designs with respect to the glue nozzle using a displacement transducer;

(b) positioning a read-in form on top of at least one of said webs, said read-in form having read-in indications thereon;

(c) sensing the position of said read-in indications on said read-in form using at least one sensing element; and (d) storing information in a control computer indicating the areas of the forms to be provided with glue as determined from said sensing element and at addresses as indicated by said displacement transducer.

25. A control device for a glue nozzle of a machine for gluing together at least two paper webs, each provided with recurring forms thereon, for producing multi-part sets of continuous forms comprising:

transducer means for determining the position of the beginning of each form on one of said webs with respect to the glue nozzle and for generating a displacement signal indicative of displacement from the position;

a read-in form adapted to be positioned atop at least one of said webs during a read-in mode, the read-in form being provided with read-in indications positioned in correspondence with areas on the form to receive glue;

sensing means disposed within sensing range of the read-in form during the read-in mode for sensing the read-in indications during the read-in mode and generating a glue signal indicative of the presence of the read-in indication;

control circuit means indicating a computer, responsive during the read-in mode to the displacement signals and the glue signals for storing an indication of those of the displacement signals which correspond to a glue signal, and during a glue mode, responsive to the displacement signals and generating a control signal when a displacement signal corresponds to a displacement signal for which an indication has been stored; and output means responsive to the control signal for switching the glue nozzle on and off.

26. A method for controlling a glue nozzle of a machine for gluing together at least two paper webs, each provided with recurring forms thereon, for producing multi-part sets of continuous forms, said method having a read-in routine and a glue routine, said read-in routine comprising the steps of:

determining the position of the beginning of each form on one of said webs with respect to the glue nozzle;

generating a displacement signal indicative of displacement from said beginning position;

positioning a read-in form having read-in indications thereon atop at least one of the forms on at least one of the webs so that the read-in indications occupy positions at least laterally corresponding to positions on the form to receive glue;

sensing the positions of the read-in indications on the read-in form atop the at least one web as the webs move through the machine;

generating a glue signal indicative of the sensing of the read-in indication; and storing indications of those displacement signals which coincide with glue signals; and said glue routine following said read-in routine and comprising the steps of:

determining the position of the beginning of each form on one of said webs with respect to the glue nozzle;

generating a displacement signal indicative of displacement from said beginning position; and generating a control signal and so causing the glue nozzle to release glue when the stored indication indicates that the displacement signal corresponds to a displacement signal which coincided with a glue signal.

* * * * *